US005937464A

United States Patent [19]

Niederman

[11] Patent Number: 5,937,464

[45] Date of Patent: Aug. 17, 1999

[54] FOLDABLE FOAM MATTRESS WITH COIL SPRINGS AND FIRM PERIPHERY

[76] Inventor: Alfred G. Niederman, 946 Rollingwood Rd., Highland Park, Ill. 60035

[21] Appl. No.: 09/070,353

[22] Filed: Apr. 30, 1998

[51] Int. Cl.[6] ..... A47C 27/20

[52] U.S. Cl. ..... 5/718; 5/727

[58] Field of Search ..... 5/718, 727, 716, 5/739, 740, 690

[56] References Cited

U.S. PATENT DOCUMENTS

| | | | |
|---|---|---|---|
| 3,210,781 | 10/1965 | Pollock | 5/718 |
| 3,287,748 | 11/1966 | Trogdon et al. | 5/727 |
| 3,401,411 | 9/1968 | Morrison | 5/718 |
| 3,732,586 | 5/1973 | Frey | 5/727 |
| 4,429,427 | 2/1984 | Sklar | 5/718 |
| 4,862,540 | 9/1989 | Savenije | 5/718 |
| 5,701,623 | 12/1997 | May | 5/739 |

*Primary Examiner*—Alex Grosz
*Attorney, Agent, or Firm*—Greer, Burns & Crain, Ltd.

[57] ABSTRACT

A sleeping mattress is disclosed which is particularly adapted for use in sofa beds and has a resilient foam main portion and a peripheral edge portion along the sides, with the edge portions being made of greater density, less compression resilient foam material. The mattress has a covering fitting over said main portion and said peripheral edge portion, with the main portion having a plurality of openings with coil springs located within the openings.

4 Claims, 1 Drawing Sheet

FOLDABLE FOAM MATTRESS WITH COIL SPRINGS AND FIRM PERIPHERY

The present invention generally relates to bed mattresses, and more particularly relates to an improved mattress construction that utilizes a combination of a foam material and coiled springs.

There have been improvements made in the design and manufacturing of mattresses through the years, and because of the obvious importance of mattresses in our daily lives, attention is still being given to making improvements in them. While continued research and development in the area of bed mattresses has resulted in many quality products having very diverse designs and construction materials. Many box spring and bed mattress combinations have complex designs and elaborate construction and are often quite expensive.

There continues to be a need for mattresses that are relatively simple in their design and construction that can be marketed at a more affordable price, but which nonetheless provide durability and comfort for the user. There is also a need for mattresses which can be used in sofa beds of the type which fold out for use as a bed, but which can be folded back to return to the appearance of a sofa.

Accordingly, it is a primary object of the present invention to provide an improved sleeper mattress that is simple in its design and construction and exhibits superior comfort and support to a user.

Another object of the present invention is to provide such an improved sleeper mattress that is inexpensive to manufacture because of its superior and simple design.

Still another object of the present invention is to provide such an improved sleeper mattress that is particularly adapted for use with sofa beds.

An ancillary object lies in the provision of providing extraordinary support and comfort when used in a sofa bed, even though it will easily fit within the storage volume of standard sofa beds.

Yet another object is to provide such an improved mattress that is particularly suited for use in a sofa bed because it does not exhibit the uncomfortable tendency for a reclining person to feel the well known bar portion of the unfolded articulated bed frame.

Still another related object is to provide such an improved mattress that has a firmer edge support that greatly reduces if not eliminates the well known feeling of falling through between the mattress and the side of the articulated bed frame of a sofa bed when sitting on the side of the mattress.

These and other objects and advantages will become apparent from reading the following detailed description while referring to the attached drawings, in which:

FIG. 1 is a plan view of the preferred embodiment of the present invention, and is shown with portions removed; and, FIG. 2 is a cross sectional view of the embodiment shown in FIG. 1, but without showing the coil springs that are present in FIG. 1, and is taken generally along the line 2—2 of FIG. 1.

DETAILED DESCRIPTION

Broadly stated, the present invention is directed to an improved mattress that has many desirable connectional features that makes it easily and inexpensively fabricated and also provides superior comfort for a user. The mattress utilizes resilient foam materials as a major component of its construction, and also includes a plurality of coil springs to provide desirable support in preferably all but the peripheral areas of the mattress. A significant feature of the mattress is the use of a more dense, less compressible foam material at the outer periphery of at least the sides of the mattress, which provides increased support for anyone sitting on the edge of the bed.

Figure 1:
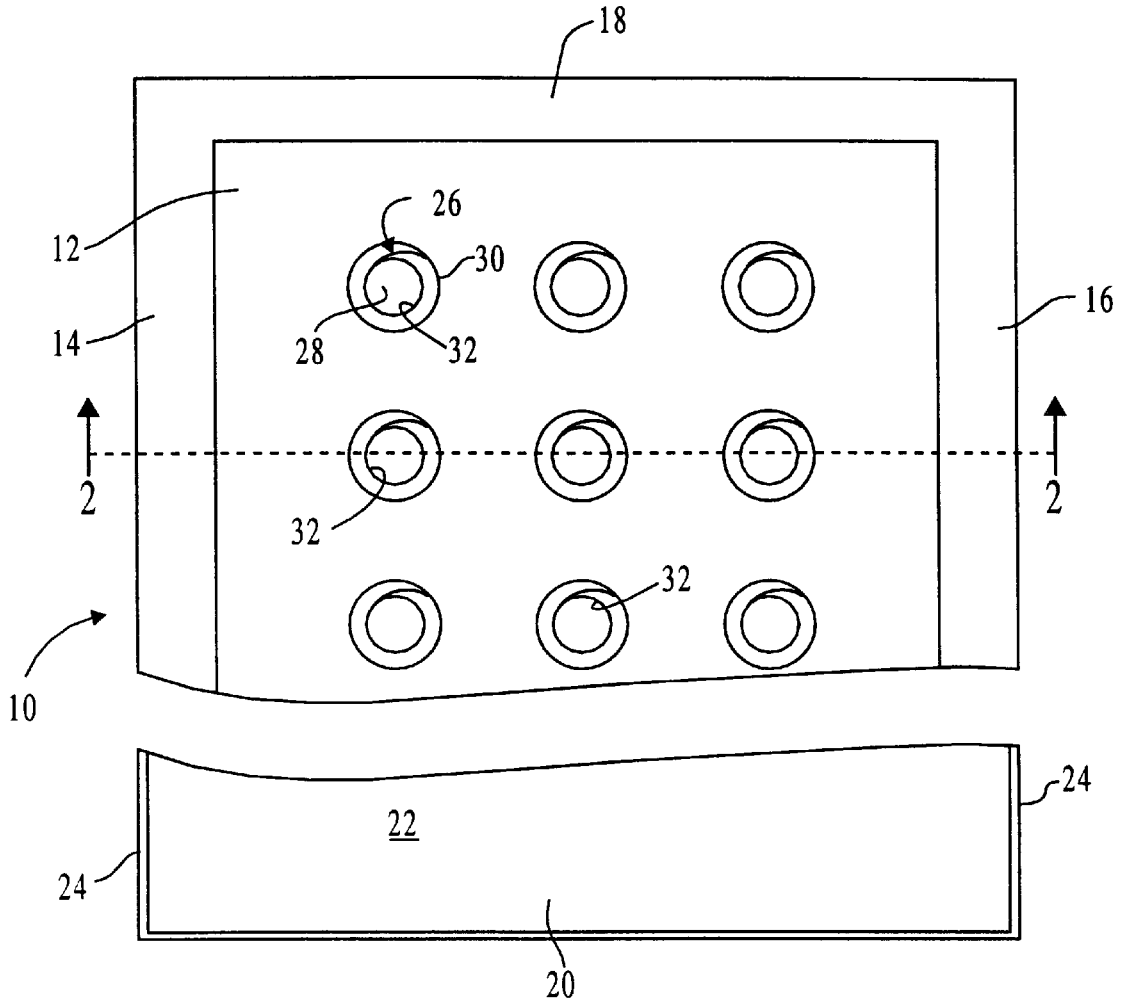
Figure 2:
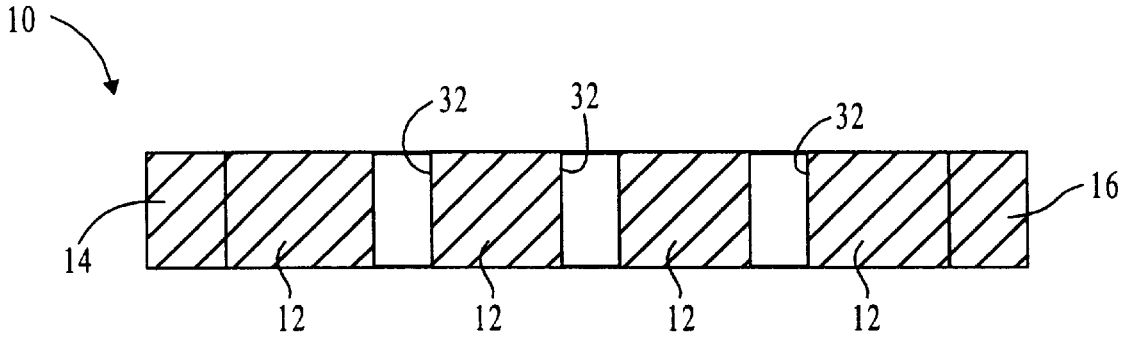

Turning now to the drawings, a mattress embodying the present invention is shown generally at 10, and is shown with portions removed in two respects. In the top portion of FIG. 1 the mattress has a preferably rectangular main portion 12 and an outer peripheral portion along the left and right sides 14 and 16, respectively, and the ends 18 and 20. The lower end 20 is shown broken away from the upper portion and has an outer covering 22, with piping 24 at the edges as is commonly present in mattress construction. While the overall shape of the mattress illustrated is rectangular, the present invention is not limited to rectangular shaped mattresses and may be used with mattresses of other shapes. The covering may include ticking layers and a quilted effect if desired.

The thickness of the mattress 10 may vary but is preferably within the range of about 4.25 inches to about 7 inches. The width of the side and end peripheral portions may also vary, but is preferably within the range of about 3 inches to about 5 inches.

There are preferably coil springs, indicated generally at 26, provided in a plurality of locations in the main portion 12 of the mattress 10, each of the springs 26 being positioned in a preferably circular opening 28 having a diameter of about 1½ to about 2 inches, in the main portion 12. The springs have two outer end portions 30 with an outer diameter of about 3 inches that are larger than the central portion 32 between the end portions, and the central portion has a diameter that is generally the same as the diameter of the openings 28. When one of the springs is compressed, the outer end portions 30 will tend to compress the adjacent main portion 12 in the immediate area of the spring 26. It should be understood that the number of openings and springs 26 can vary significantly, depending upon the overall size of the mattress 10, the strength and size of the springs, the firmness that is desired and other design criteria.

In accordance with an important aspect of the present invention, the main portion 12 is preferably comprised of a fire retardant urethane foam material, although it is not necessary to the present invention that the material either be fire retardant or urethane. Other foam materials that demonstrate the desired compression and resilient characteristics can be used. However, the preferred embodiment illustrated is preferably a urethane foam material having a density of about 1.8 pounds per square foot and a compression value that is within the range of about 29 to about 33. In this regard, the compression value is its resistance to compression when weight is applied to the material to result in 25% deflection. The value of 31 is pounds per square foot of surface area.

With regard to the outer peripheral portions 14, 16, 18 and 20, these portions are preferably made from more dense, less compressible foam material, and in the preferred embodiment, are also made of a fire retardant urethane foam material, although again, it is not necessary to the present invention that the material either be fire retardant or urethane. The preferred material is a urethane foam material having a density of about 2.0 pounds per cubic foot and a compression value that is within the range of about 63 to about 67.

Although it is not critical to the invention, the foam material of the main portion 12 is preferably glued to the peripheral portions with a water-based glue, although other bonding materials may be used.

From the foregoing, it should be understood that a mattress construction has been shown and described that has many desirable attributes in terms of its use, quality, durability and support. The use of a more dense, less compressible peripheral portion along at least the sides of the mattress, and preferably around the entire perimeter of the mattress, provides very desirable increased support for one who is seated on the side or end of the bed. This greatly reduces, if not virtually eliminates the feeling that one will fall between the mattress and the bed frame that one often experiences when sitting at the side of a sofa bed.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A foldable mattress for a sofa bed said mattress comprising:

a main portion having opposite end portions and opposite side portions, said portion being comprised of a resilient foam material having a density of about 1.8 lbs/cubic foot, a compression value within the range of about 29 to about 33 lbs. and a thickness within the range of about 4¼ inches to about 7 inches;

a peripheral edge portion extending at least along said opposite sides, said edge portions having a predetermined width and being comprised of a resilient foam material having a density of about 2.0 lbs/cubic foot, a compression value within the range of about 63 to about 67 lbs. and a thickness within the range of about 4¼ inches to about 7 inches; and a mattress covering fitting over said main portion and said peripheral edge portion;

said main portion having a plurality of openings of predetermined size and coil springs located within said openings.

2. A mattress as defined in claim 1 wherein said predetermined width of said edge portion is narrow compared to the overall width of the mattress itself.

3. A mattress as defined in claim 1 wherein said predetermined width of said edge portion is within the range of about 3 inches to about 5 inches.

4. A mattress as defined in claim 1 wherein said peripheral edge portion extends substantially around the entire periphery of said main portion.

* * * * *